US005775423A

United States Patent [19]

Kaczynski

[11] Patent Number: 5,775,423

[45] Date of Patent: Jul. 7, 1998

[54] VALVE FOR A TWO WAY HYDRAULIC DRILLING JAR AND A TWO WAY HYDRAULIC DRILLING JAR

[75] Inventor: Aureliusz Eric Tadeusz Kaczynski, Edmonton, Canada

[73] Assignee: A.T.K. Enterprises Inc., Edmonton, Canada

[21] Appl. No.: 723,538

[22] Filed: Sep. 30, 1996

[51] Int. Cl.[6] ..... E21B 23/00; F16K 47/00

[52] U.S. Cl. ..... 166/178; 175/297; 251/126

[58] Field of Search ..... 166/178; 175/297; D23/233; 251/62, 126

[56] References Cited

U.S. PATENT DOCUMENTS 4,111,271 9/1978 Perkins ..... 175/297

5,647,446 7/1997 Wenzel ..... 175/297

*Primary Examiner*—Tamara L. Graysay

*Assistant Examiner*—Gary S. Hartmann

*Attorney, Agent, or Firm*—Anthony R. Lambert

[57] ABSTRACT

A valve for a two way hydraulic drilling jar which includes a hollow cylindrical member having an exterior surface, an interior surface, a first end and a second end. At least one spiral-form fluid bypass passage is positioned in each of the first end and the second end of the cylindrical member. The at least one spiral-form bypass passages has a first end communicating with the exterior surface and a second end communicating with the interior surface.

8 Claims, 4 Drawing Sheets

VALVE FOR A TWO WAY HYDRAULIC DRILLING JAR AND A TWO WAY HYDRAULIC DRILLING JAR

FIELD OF THE INVENTION

The present invention relates to a valve for a two way hydraulic drilling jar and a two way hydraulic drilling jar.

BACKGROUND OF THE INVENTION

A drilling jar is placed on a drill string attached to a drill bit when drilling oil and gas wells. As the name drilling "jar" implies, the function of this tool is to provide a jarring impact to free the drill bit, should it become stuck. A drilling jar generally consists of a first tubular member which telescopically receives a second tubular member. The second tubular member is capable of limited axial movement within the first tubular member, referred to as a "stroke". The first tubular member has an impact surface referred to as an "anvil". The second tubular member has an impact surface referred to as a "hammer". At the end of each stroke, the hammer and anvil are brought into violent contact.

With a two way drilling jar the second tubular member is capable of both an upstroke and a downstroke from a central starting position. The first tubular member has two anvils; a first anvil positioned at the end of the upstroke and a second anvil positioned at the end of the downstroke. The second tubular member has two hammers, a first hammer which impacts against the first anvil at the end of the upstroke and a second hammer which impacts against the second anvil at the end of the downstroke.

A hydraulic drilling jar has a valve member that is positioned in a fluid chamber. The fluid chamber has a restriction just large enough to accommodate the valve member. When the restriction is encountered, the valve member becomes lodged within the restriction, until sufficient hydraulic fluid bleeds past via one or more bypass passages. The advantage this provides is that a time delay is created prior to the violent jarring impact of the hammer and anvil occurring. The key to the operation of an hydraulic drilling jar is the configuration of the valve member.

SUMMARY OF THE INVENTION

The present invention relates to a two way hydraulic drilling jar with an unique valve member.

According to one aspect of the present invention there is provided a valve for a two way hydraulic drilling jar which includes a hollow cylindrical member having an exterior surface, an interior surface, a first end and a second end. At least one spiral-form fluid bypass passage is positioned in each of the first end and the second end of the cylindrical member. The at least one spiral-form bypass passages has a first end communicating with the exterior surface and a second end communicating with the interior surface.

According to another aspect of the present invention there is provided a two way hydraulic drilling jar which includes a first tubular member and a second tubular member. The first tubular member has an exterior surface and an interior surface that defines an interior bore. The interior surface of the first tubular member has a first impact surface and a second impact surface in spaced relation. The second tubular member has an exterior surface and an interior surface that defines an interior bore. The second tubular member is telescopically received within the interior bore of the first tubular member. The exterior surface of the second tubular member has a first impact surface and a second impact surface. The second tubular member is capable of limited axial movement relative to the first tubular member. Upon relative movement in a first direction the first impact surface of the second tubular member and the first impact surface of the first tubular member are brought into violent jarring contact. Upon relative movement in a second direction the second impact surface of the second tubular member and the second impact surface of the first tubular member are brought into violent jarring contact. An annular fluid chamber is positioned between the interior surface of the first tubular member and the exterior surface of the second tubular member. The fluid chamber has a first end and a second end. Means is provided to seal the first end and the second end of the fluid chamber. The fluid chamber has a restriction intermediate the first end and the second end. A hollow cylindrical member is disposed in the annular fluid chamber and sized to pass through the restriction. The cylindrical member has an exterior surface, an interior surface, a first end and a second end. At least one spiral-form fluid bypass passage is positioned in each of the first end and the second end of the cylindrical member. The at least one spiral-form bypass passage has a first end communicating with the exterior surface and a second end communicating with the interior surface. The cylindrical member is mounted to one of first tubular member and the second tubular member with a first contact surface engaging the first end and a second contact surface engaging the second end. The cylindrical member restricts the flow of hydraulic fluid when positioned in the restriction such that relative movement of the first tubular member and the second tubular member can only occur once sufficient hydraulic fluid has bypassed the restriction.

Hydraulic fluid bypasses the restriction by entering from the exterior of the cylindrical member into the first end of one of the at least one spiral-form bypass passage at one of the first end and the second end of the cylindrical member, passing along said at least one spiral-form bypass passage to the interior of the cylindrical member. Hydraulic fluid enters from the interior of the cylindrical member into the second end of the at least one spiral-form bypass passage at the other of the first end and the second end, and passes along said at least one spiral-form bypass passage to the exterior of the cylindrical member.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
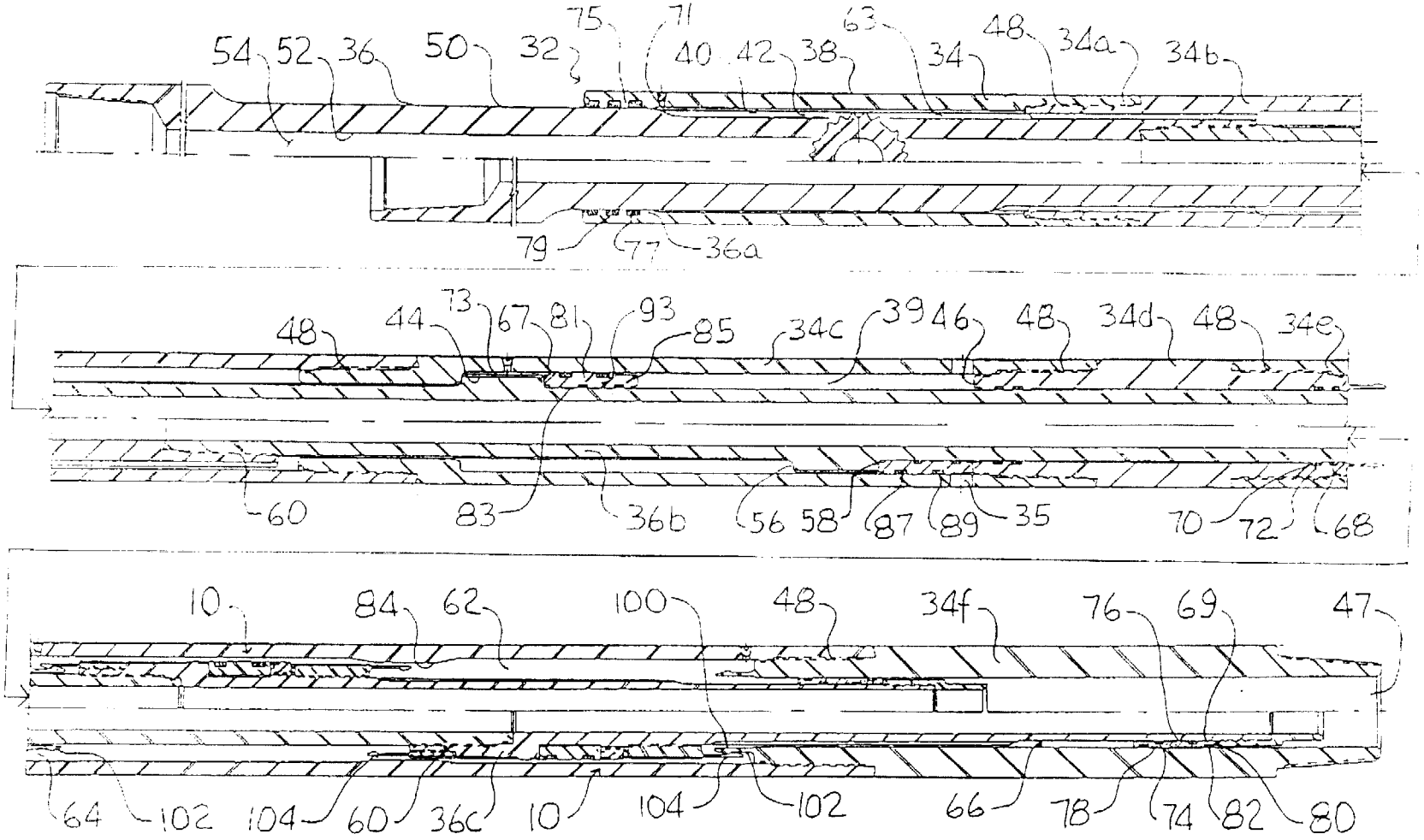
FIG. 1 is a side elevation view, in section, of a two way hydraulic drilling jar constructed in accordance with the teachings of the present invention, the Figure is divided into two halves along a center line with a top half in an upstroke impact position and a bottom half in a down stroke impact position.

The preferred embodiment, a valve for a two way hydraulic drilling jar generally identified by reference numeral 10, will now be described with reference to FIGS. 1 through 4.

Figure 2:
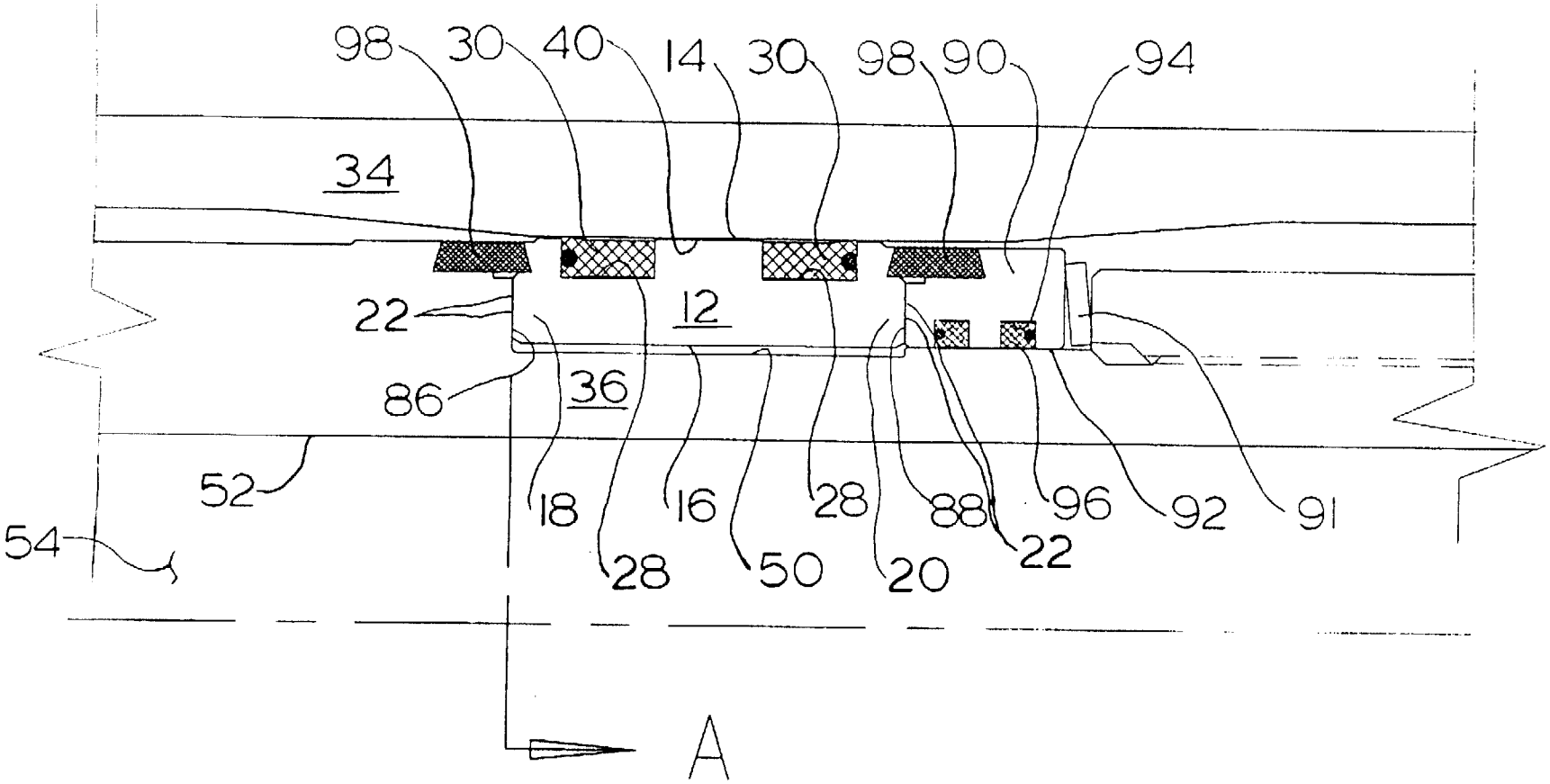
FIG. 2 is a detailed side elevation view of a valve portion of the two way hydraulic drilling jar illustrated in FIG. 1.
Figure 3:
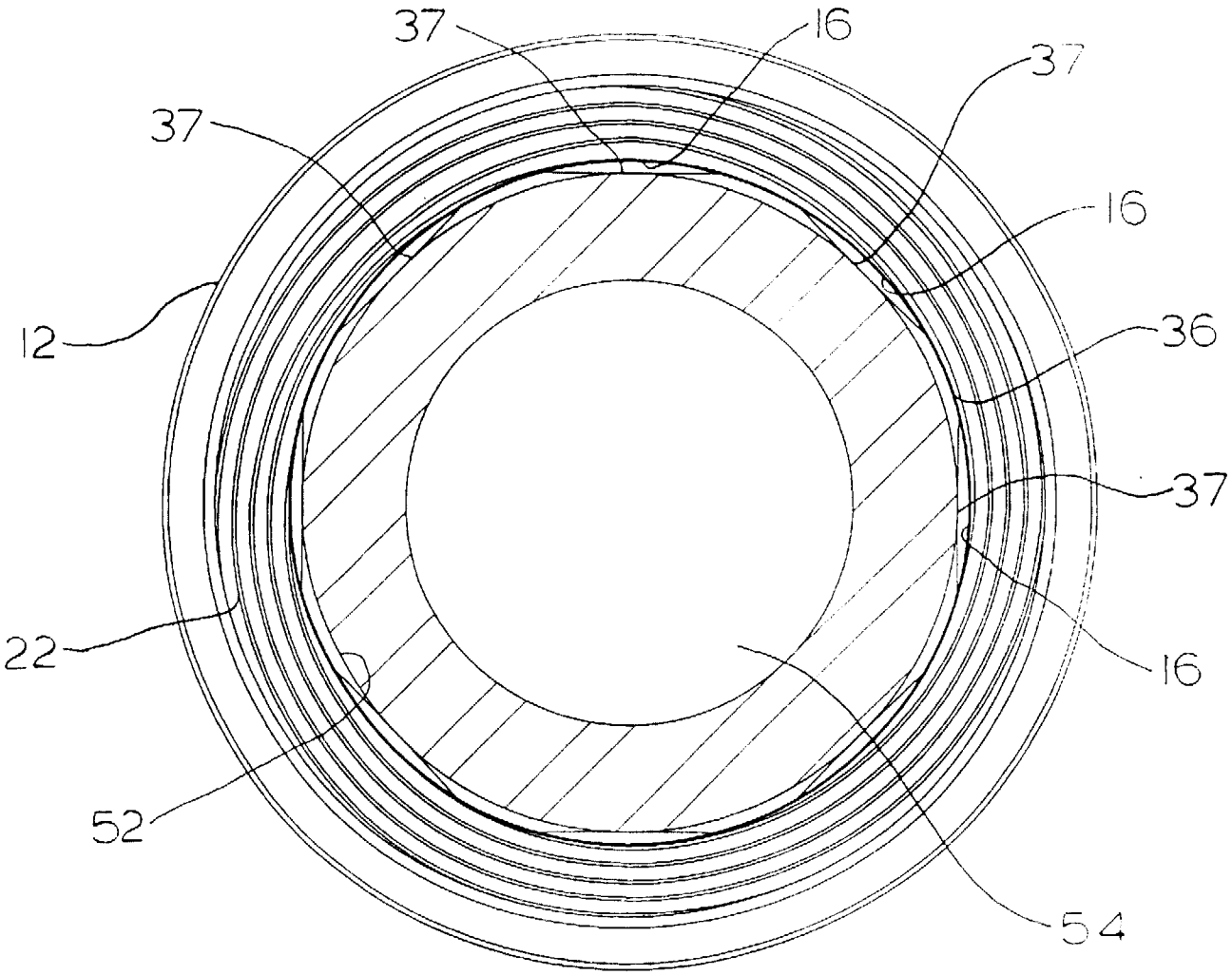
FIG. 3 is a transverse section view taken along section lines A—A adjacent one end of a valve portion of the two way hydraulic drilling jar illustrated in FIG. 2.
Figure 4:
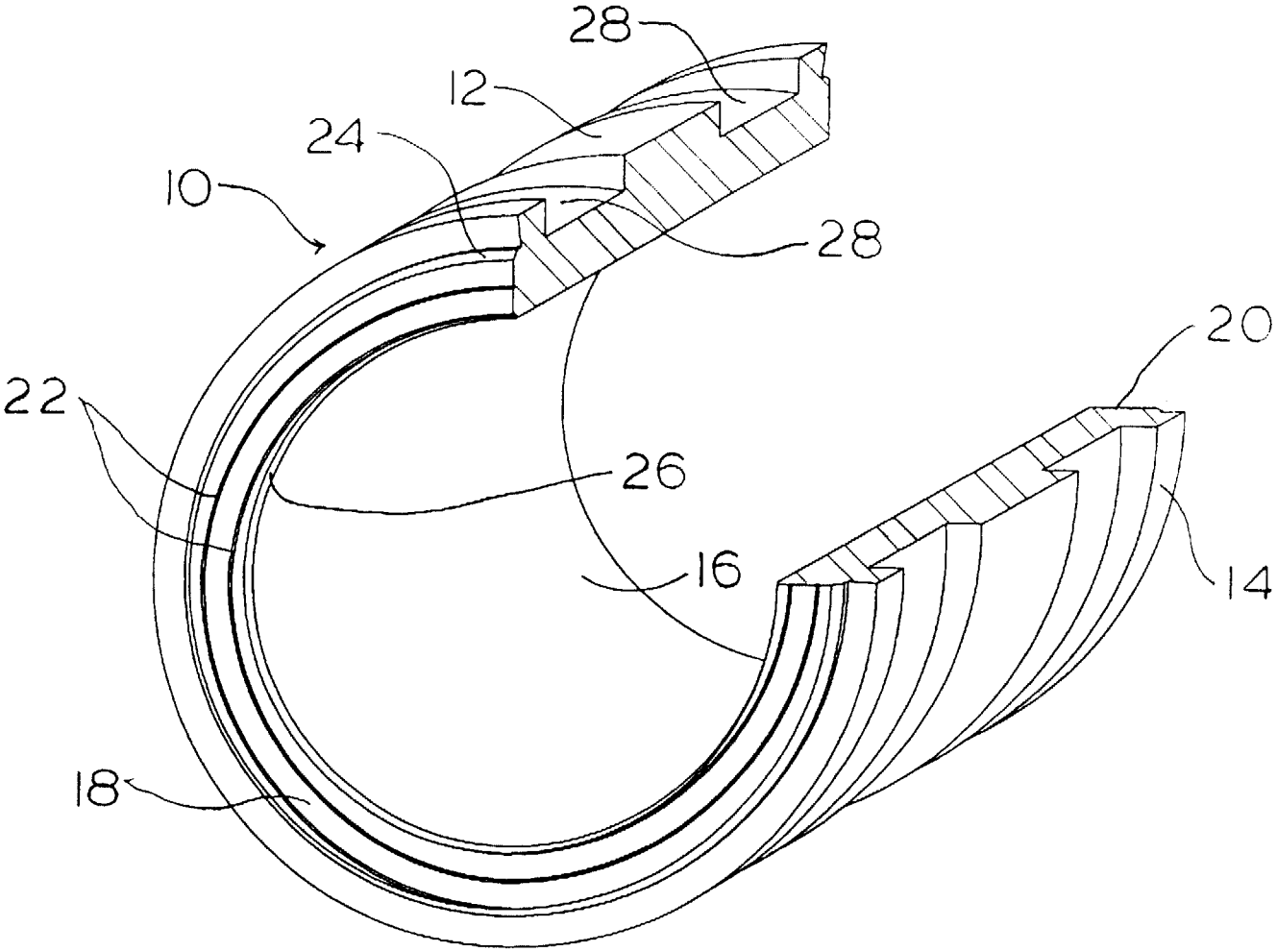
FIG. 4 is a partially cut away perspective view of a simplified embodiment of a valve for use in a two way hydraulic drilling jar constructed in accordance with the teachings of the present invention.

Referring to FIG. 4, valve 10 includes a hollow cylindrical member 12 having an exterior surface 14, an interior surface 16, a first end 18 and a second end 20. At least one spiral-form fluid bypass passage 22 is positioned in each of first end 18 and second end 20 of cylindrical member 12. In FIG. 4, which is a simplified version, two fluid bypass passages 22 are illustrated to demonstrate the underlying principle. In FIG. 3, multiple fluid bypass passages 22 are provided. Referring to FIG. 4, each of spiral-form bypass passages 22 has a first end 24 communicating with exterior surface 14 and a second end 26 communicating with interior surface 16. Exterior surface 14 of cylindrical member 12 has seal grooves 28. Referring to FIG. 2, elastomer seals 30 are positioned in seal grooves 28.

Referring to FIG. 1, valve 10 is intended for incorporation in a two way hydraulic drilling jar, generally identified by reference numeral 32. The primary components of two way drilling jar 32 are a first tubular member 34 and a second tubular member 36. First tubular member 34 has an exterior surface 38 and an interior surface 40 that defines an interior bore 42. Interior surface 40 of first tubular member 34 has a first impact surface or anvil 44 and a second impact surface or anvil 46 positioned in spaced relation. For ease of assembly, first tubular member 34 is made out of a number of axially aligned sections 34a, 34b, 34c, 34d, 34e, and 34f. Each of the described sections are connected at threaded connections 48. Second tubular member 36 has an exterior surface 50 and an interior surface 52 that defines an interior bore 54. Second tubular member 36 is telescopically received within interior bore 42 of first tubular member 34. Exterior surface 50 of second tubular member 36 has a first impact surface or hammer 56 and a second impact surface or hammer 58.

Second tubular member 36 is capable of limited axial movement relative to first tubular member 34, this has been illustrated in FIG. 1 by showing second tubular member 36 in two positioned relative to first tubular member 34. Upon relative movement in a first direction first hammer 56 of second tubular member 36 and first anvil 44 of first tubular member 34 are brought into violent jarring contact. Upon relative movement in a second direction second hammer 58 of second tubular member 36 and second anvil 46 of first tubular member 34 are brought into violent jarring contact. For ease of assembly second tubular member 36 is made out of a number of axially aligned sections **36*a*, 36*b*, and 36*c*. Each of the described sections are connected at threaded connections 60. Two annular fluid chambers 62 and 63 are positioned between interior surface 40 of first tubular member 34 and exterior surface 50 of second tubular member 36. Fluid chamber 62 has a first end 64 and a second end 66. A first seal assembly 68 is positioned at first end 64 of chamber 62. A second seal assembly 69 is positioned at second end 66 of chamber 62. First seal assembly 68 consists of a plurality of seal grooves 70 in which are disposed elastomer seals 72. Second seal assembly 69 includes a floating piston 74. Floating piston 74 has an interior surface 76 and an exterior surface 78. Both interior surface 76 and exterior surface 78 have seal grooves 80 in which are disposed elastomer seals 82. Fluid chamber 63 has a first end 71 and a second end 73. A first seal assembly 75 is positioned at first end 71, consisting of a plurality of seal grooves 77 in which are disposed elastomer seals 79. A second seal assembly 79 is positioned at second end 73. Second seal assembly 79 includes a knocker piston 81. Knocker piston 81 has an interior surface 83 and an exterior surface 85. Both interior surface 83 and exterior surface 85 have seal grooves 87 in which are disposed elastomer seals 89. Positioned between fluid chamber 62 and fluid chamber 63 is a chamber 39 through which drilling fluid can enter into the tool by radial access openings 35. When drilling fluids are pumped down from surface pumps and pass from interior bore 54 of second tubular member 36. Fluid pressure is exerted upon floating piston 74, and floating piston 74 moves in response to such pressure. As drilling fluids pass back up the annulus along exterior surface 38 of first tubular member 34, the drilling fluids enter chamber 39 through access openings 35. Knocker piston 81 also moves in response to pressure exerted by the drilling fluids. This movement of pistons 74 and 81, reduces back pressure on second tubular member 36. Fluid chamber 62 has a restriction 84 positioned intermediate first end 64 and second end 66. Hollow cylindrical member 12 of valve 10 is disposed in annular fluid chamber 62. Cylindrical member 12 is mounted to second tubular member 36 and moves with second tubular member 36. Referring to FIG. 3, in the seating position for cylindrical member 12, second tubular member 36 has a series of milled flats which serve as undercut fluid flow channels 37 permitting the passage of fluids between second tubular member 36 and interior surface 16 of valve member 10. Referring to FIG. 2, after assembly, a first contact surface 86 engages first end 18 and a second contact surface 88 engages second end 20 of cylindrical member 12. In the illustrated embodiment, first contact surface 86 is provided by a shoulder projecting outwardly from exterior surface 50 of second tubular member 36. Second contact surface 88 is provided by an annular sleeve 90 that is biased by a spring 91 into engagement with second end 20 of cylindrical member 12. Interior surface 92 of annular sleeve 90 has several seal grooves 94 in which are positioned elastomer seals 96 in order to prevent leakage. Cylindrical member is sized to just barely pass through restriction 84. This is made easier by the presence of elastomer seals 30 on exterior surface 14 of cylindrical member 12. Metal expands and contracts when it is subjected to heat. In the prior art valves, problems been experienced with the valves expanding when heated and becoming jammed in the restriction. When the valves are modified to prevent jamming the valves have passed through the restrictions too easily. Elastomer seals 30 on cylindrical body 12 of valve 10 are preferred as they enable cylindrical member 12 to prevent the flow of hydraulic fluid through restriction 84, without risk of cylindrical member 12 becoming jammed in restriction 84. With cylindrical member 12 restricting the flow of hydraulic fluid through restriction 84, relative movement of first tubular member 34 and second tubular member 36 can only occur once sufficient hydraulic fluid has bypassed restriction 84 by bleeding through spiral-form bypass passages 22. In order to ensure that particulate matter does not clog bypass passages 22, a filter 98 is positioned at first end 24 of the spiral-form bypass passages 22 which catches particulate contaminants before they can enter spiral-form bypass passages 22. A drilling jar can be operated in an unlocked position in which there can be movement, however, it is preferred that the drilling jar be kept in the locked position. The preferred manner of locking an hydraulic drilling jar is by means of a mechanical latch. Referring to FIG. 1, a mechanical latch 100 is, therefore, provided with a first clutch engagement 102 secured to first tubular member 34 and a second clutch engagement 104 secured to second tubular member 36. In a particular relative telescopic position, clutch engagement 102 and clutch engagement 104 interlock to place two way hydraulic drilling jar 32** in a locked position.

The use of valve member 10 in the operation of two way hydraulic drilling jar 32 will now be described. Hydraulic drilling jar 32 is operated with mechanical latch 100 in an engaged position. When jarring is required, hydraulic drilling jar 32 is placed in tension, thereby releasing mechanical latch 100 and leaving the drilling jar 32 operating on a purely hydraulic basis. The release pressure depends upon size. For example in a 6 ½ inch diameter tool, mechanical latch 100 is typically set so that a force of 20,000 to 30,000 pound is required to trigger its release. Cylindrical member 12 is moved into restriction 84, in preparation for either a jarring upstroke or a jarring downstroke. With the flow of hydraulic fluids through restriction 84 precluded by cylindrical member 12, relative movement of first tubular member 34 and second tubular member 36 can only occur once sufficient hydraulic fluid has bypassed restriction 84. Hydraulic drilling jar is then placed in tension so that there is a force build up that will be released as soon as valve 10 moves out of restriction 84. For example with a 6 ½ inch tool, the force placed upon the tool, typically, will be 60,000 or 70,000 pounds with a time delay of 45 to 60 seconds. The time delay can be altered, however, by changing the width and length of spiral-form fluid bypass passages 22. There is a difference in force required for an upstroke and a downstroke. On the upstroke, the force of the hydrostatic head must be overcome, which may add an additional 30,000 pounds to the force exerted. The fluids bypass restriction 84 by entering through filters 98 from exterior 14 of cylindrical member 12 into first end 24 of spiral-form bypass passages 22. Whether hydraulic fluids enter from first end 18 or second end 20 of cylindrical member 12 depends upon whether an upstroke or a downstroke is being attempted. After entering first end 24 of spiral-form bypass passages 22, the hydraulic fluid passes along the bypass passages 22 exiting out second end 26 to interior surface 16 of cylindrical member 12. From interior surface 16 of cylindrical member 12, the hydraulic fluid passes along undercut fluid flow channel 37 and then into second end 24 of spiral-form bypass passages 22 at the other of first end 18 and second end 20 of cylindrical member 12. The hydraulic fluids then passes along spiral-form bypass passages 22 exiting filter 98 to exterior 14 of cylindrical member 12, having thereby bypassed restriction 84. In this manner cylindrical member 12 gradually moves out of restriction 84. As soon as cylindrical member 12 is no longer blocking the flow of hydraulic fluids through restriction 84, relative movement of first tubular member 34 and second tubular member 36 can occur. If the relative movement is in a first direction, first hammer 56 of second tubular member 36 and first anvil 44 of first tubular member 34 are brought into violent jarring contact. If the relative movement is in a second direction second hammer 58 of second tubular member 36 and second anvil 46 of first tubular member 34 are brought into violent jarring contact.

Valve 10 with its spiral-form bypass passages 22, as described, provides a number of advantages over other forms of valves when positioned in two way drilling jar 32. Unlike other valves that rely upon metal to metal seals, valve 10 is not temperature sensitive. A change in the time delay may be effected merely by changing the size and length of spiral-form bypass passages 22. The positioning of the filtering elements 98 prevents plugging of spiral-form bypass passages 22. They tend to be self cleaning as liquids flow through filtering elements 98 in one direction with an upstroke and in the opposite direction with a downstroke.

It will be apparent to one skilled in the art that modifications may be made to the illustrated embodiment without departing from the spirit and scope of the invention as hereinafter defined in the Claims.

The embodiment of the invention in which an exclusive property or privilege is claimed are defined as follows:

1. A valve for a two way hydraulic drilling jar, comprising:

a hollow cylindrical member having an exterior surface, an interior surface, a first end and a second end, at least one spiral-form fluid bypass passage being positioned in each of the first end and the second end of the cylindrical member, each of the at least one spiral-form bypass passages having a first end communicating with the exterior surface and a second end communicating with the interior surface.

2. A two way hydraulic drilling jar, comprising:

a first tubular member having an exterior surface and an interior surface that defines an interior bore, the interior surface of the first tubular member having a first impact surface and a second impact surface in spaced relation;

a second tubular member having an exterior surface and an interior surface that defines an interior bore, the second tubular member being telescopically received within the interior bore of the first tubular member, the exterior surface of the second tubular member having a first impact surface and a second impact surface, the second tubular member being capable of limited axial movement relative to the first tubular member, upon relative movement in a first direction the first impact surface of the second tubular member and the first impact surface of the first tubular member are brought into violent jarring contact, upon relative movement in a second direction the second impact surface of the second tubular member and the second impact surface of the first tubular member are brought into violent jarring contact;

an annular fluid chamber positioned between the interior surface of the first tubular member and the exterior surface of the second tubular member, the fluid chamber having a first end and a second end, means being provided to seal the first end and the second end of the fluid chamber, the fluid chamber having a restriction intermediate the first end and the second end;

a hollow cylindrical member disposed in the annular fluid chamber and sized to pass through the restriction, the cylindrical member having an exterior surface, an interior surface, a first end and a second end, at least one spiral-form fluid bypass passage being positioned in each of the first end and the second end of the cylindrical member, each of the at least one spiral-form bypass passages having a first end communicating with the exterior surface and a second end communicating with the interior surface, the cylindrical member being mounted to one of first tubular member and the second tubular member with a first contact surface engaging the first end and a second contact surface engaging the second end, the cylindrical member restricting the flow of hydraulic fluid when positioned in the restriction such that relative movement of the first tubular member and the second tubular member can only occur once sufficient hydraulic fluid has bypassed the restriction by entering from the exterior of the cylindrical member into the first end of one of the at least one spiral-form bypass passage at one of the first end and the second end of the cylindrical member, passing along said at least one spiral-form bypass passage to the interior of the cylindrical member, entering from the interior of the cylindrical member into the second end of the at least one spiral-form bypass passage at the other of the first end and the second end, and passing along said at least one spiral-form bypass passage to the exterior of the cylindrical member.

3. The two way hydraulic drilling jar as defined in claim 2, wherein the exterior surface of the cylindrical member has at least one seal groove in which is positioned an elastomer seal.

4. The two way hydraulic drilling jar as defined in claim 2, wherein a filter is positioned at the first end of the at least one spiral-form bypass passage, whereby particulate contaminants are precluded from entering the spiral-form bypass passage.

5. The two way hydraulic drilling jar as defined in claim 2, wherein a mechanical latching mechanism is positioned in the annular fluid chamber.

6. A two way hydraulic drilling jar, comprising:

a first tubular member having an exterior surface and an interior surface that defines an interior bore, the interior surface of the first tubular member having a first impact surface and a second impact surface in spaced relation;

a second tubular member having an exterior surface and an interior surface that defines an interior bore, the second tubular member being telescopically received within the interior bore of the first tubular member, the exterior surface of the second tubular member having a first impact surface and a second impact surface, the second tubular member being capable of limited axial movement relative to the first tubular member, upon relative movement in a first direction the first impact surface of the second tubular member and the first impact surface of the first tubular member are brought into violent jarring contact, upon relative movement in a second direction the second impact surface of the second tubular member and the second impact surface of the first tubular member are brought into violent jarring contact;

an annular fluid chamber positioned between the interior surface of the first tubular member and the exterior surface of the second tubular member, the fluid chamber having a first end and a second end, seals being provided at the first end and the second end of the fluid chamber, the fluid chamber having a restriction intermediate the first end and the second end;

a cylindrical member disposed in the annular fluid chamber and sized to pass through the restriction, the cylindrical member having an exterior surface, an interior surface, a first end and a second end, the exterior surface of the cylindrical member has seal groove in which are positioned elastomer seals, several spiral-form fluid bypass passages being positioned in each of the first end and the second end of the cylindrical member, each of the several spiral-form bypass passages having a first end communicating with the exterior surface and a second end communicating with the interior surface, the cylindrical member being mounted to the second tubular member with a first contact surface engaging the first end and a second contact surface engaging the second end, the second tubular member having undercut fluid flow passages which permit the flow of fluids between the exterior surface of the second tubular member and the interior surface of the cylindrical member, the cylindrical member restricting the flow of hydraulic fluid when positioned in the restriction such that relative movement of the first tubular member and the second tubular member can only occur once sufficient hydraulic fluid has bypassed the restriction by entering from the exterior of the cylindrical member into the first end of the several spiral-form bypass passages at the one of the first end and the second end of the cylindrical member, passing along said several spiral-form bypass passages to the interior of the cylindrical member, entering from the interior of the cylindrical member into the second end of the several spiral-form bypass passages at the other of the first end and the second end of the cylindrical member, and passing along said several spiral-form bypass passages to the exterior of the cylindrical member.

7. The two way hydraulic drilling jar as defined in claim 6, wherein a filter is positioned at the first end of the at least one spiral-form bypass passage, whereby particulate contaminants are precluded from entering the spiral-form bypass passage.

8. The two way hydraulic drilling jar as defined in claim 6, wherein a mechanical latching mechanism is positioned in the annular fluid chamber.

* * * * *